US005795251A

United States Patent [19]

Andersen

[11] Patent Number: 5,795,251

[45] Date of Patent: Aug. 18, 1998

[54] ROTARY BATTING PRACTICE APPARATUS

[76] Inventor: Gerald P. Andersen, 1318 E. Lavieve, Tempe, Ariz. 85284

[21] Appl. No.: 794,621

[22] Filed: Feb. 3, 1997

[51] Int. Cl.[6] ..... A63B 69/00

[52] U.S. Cl. ..... 473/427

[58] Field of Search ..... 473/427, 429, 473/606, 351, 134, 135, 138, 160, 451, 430, 393, 397

[56] References Cited

U.S. PATENT DOCUMENTS

| | | | |
|---|---|---|---|
| 1,634,146 | 6/1927 | Henry | 473/607 |
| 2,818,255 | 12/1957 | Ponza | 473/429 |
| 3,118,670 | 1/1964 | Smith | 473/429 |
| 3,333,847 | 8/1967 | Pennington . | |
| 3,547,437 | 12/1970 | Anderson | 473/427 |
| 3,794,320 | 2/1974 | Salmont | 473/429 |
| 3,885,790 | 5/1975 | Parr . | |
| 3,904,201 | 9/1975 | Henry | 423/607 |
| 4,596,389 | 6/1986 | Frankowski | 473/607 |
| 4,706,964 | 11/1987 | Genovese . | |
| 4,872,675 | 10/1989 | Crowden | 473/427 |
| 5,018,729 | 5/1991 | Wilkerson . | |
| 5,083,775 | 1/1992 | Heard . | |
| 5,275,396 | 1/1994 | Sudia | 473/427 |
| 5,282,615 | 2/1994 | Green et al. . | |
| 5,467,979 | 11/1995 | Zarate | 473/429 |

FOREIGN PATENT DOCUMENTS

| | | | |
|---|---|---|---|
| 2028666 | 3/1980 | United Kingdom | 473/138 |

*Primary Examiner*—Theatrice Brown
*Attorney, Agent, or Firm*—H. Gordon Shields

[57] ABSTRACT

Batting practice apparatus includes a variable speed motor connected to a rotatable shaft by a belt, and the rotatable shaft includes a pair of arms extending outwardly from the shaft. At the outer ends of the arms are cords connected to the shaft, and balls are secured to the outer ends of the cords. The motor is a variable speed motor, and the motor rotates the shaft to rotate the arms and the balls. The shaft is secured to a base, and the base is tiltable so that the arms may move in a tilted plain, as desired, to provide different orientations of the balls to a user practicing batting with the apparatus.

8 Claims, 2 Drawing Sheets

HIT
M

ROTARY BATTING PRACTICE APPARATUS

BACKGROUND OF THE INVENTION

1. Field of the Invention

This invention relates to batting practice apparatus and, more particularly, to batting practice apparatus which includes a base and rotating arms, with balls secured to the outer end of a rotating arm.

2. Description of the Prior Art

U.S. Pat. No. 3,547,437, the inventor of which is the inventor herein, describes batting practice apparatus in which a rotatable vertical shaft includes multiple adjustable horizontal arms, with balls extending outwardly from cords secured to the ends of the arms. Three arms were disclosed, one arm relatively low, one arm in the middle, and one arm relatively high. The three arms essentially allowed users to practice batting low balls, medium, and high balls.

The '437 apparatus was also adaptable to balls other than baseballs, and gave users an opportunity to practice hitting tennis balls, or the like. The rotating speed of the shaft with its arms was variable so that various speeds of the balls could be involved.

The present invention comprises essentially a second generation of the rotating batting practice apparatus.

U.S. Pat. No. 3,333,847 (Pennington) discloses a base and a rotating post extending upwardly from the base, and an arm extending outwardly from the rotating post. A ball is secured to a line or cord extending at the outer end of the arm.

U.S. Pat. No. 3,885,790 (Parr) discloses a base with a post extending upwardly from the base and an arm extending outwardly from the post at a fixed angle. A ball is tethered to a relatively short cord secured to the end of the arm.

U.S. Pat. No. 4,706,964 (Genovese) discloses a football training apparatus in which a football is attached to the end of a line mounted in a winding and unwinding unit which is secured to one end of an adjustable boom. The adjustable boom is in turn secured to a post, and the post is mounted on a movable base. The winding and unwinding system includes a reel mounted on bearings.

U.S. Pat. No. 4,872,675 (Crowden) discloses a base and a rotating post extending slightly upwardly from the base. A counter weighted arm in in turn secured to the post for rotation. The arm is horizontally aligned. A cord or line is secured to the outer end of the arm and a ball is in turn secured to the cord.

U.S. Pat. No. 5,018,729 (Wilkerson) discloses a base with an arm extending upwardly and outwardly from the base. The arm is adjustable at different heights on a vertical arm secured to the base. At the outer end of the arm is a line or cord, and a ball is secured to the line.

U.S. Pat. No. 5,083,775 (Heard) discloses a base with a straight arm extending from the base. The arm is capable of being oriented in a plurality of angular orientations or positions relative to the base. At the otuer end of the arm is a cord, and a ball is secured to the cord.

U.S. Pat. No. 5,275,396 (Sudia) discloses a tripod base and an arm extending generally straight outwardly from a shaft extending upwardly from the base. A cord, with a ball tied to its outer end, is in turn secured to the outer end of the arm.

U.S. Pat. No. 5,282,615 (Green) discloses a base with a pair of relatively short arms extending in opposite directions outwardly from the post. The arms extend outwardly a short distance and then extend downwardly. Balls are in turn secured to relatively short cords secured to the outer ends of the arms.

SUMMARY OF THE INVENTION

The invention described and claimed herein comprises batting practice apparatus in which a rotating shaft is secured to a variable speed motor and a pair of arms extend outwardly from the shaft. The arms are curved, and cords at the ends of the arms provide balls extending outwardly from the ends of the arms. The rotating shaft is secured to a base, and the base may be tilted to provide multiple different orientations of the ball, such as a rising ball, a falling or downwardly sloping ball, as well as a steady high ball and a steady low ball.

Among the objects of the present invention are the following:

To provide new and useful batting practice apparatus;

To provide new and useful batting practice apparatus having a base, a rotatable shaft, and a pair of arms extending outwardly from the rotating shaft;

To provide new and useful batting practice apparatus having a relatively short rotatable shaft and a pair of curved arms extending outwardly and upwardly from the rotatable shaft;

To provide new and useful batting practice apparatus having a rotatable shaft and a pair of arms extending from the shaft to which balls are secured, and a tiltable base secured to the shaft for varying the orientation of the rotating arms and the balls extending outwardly from the rotating arms; and To provide new and useful batting practice apparatus including a motor operatively secured to a rotating shaft and a pair of arms extending outwardly from the shaft and balls secured to the outer ends of cords, with the inner ends of the cords secured to the arms.

DESCRIPTION OF THE PREFERRED EMBODIMENT

Figures 1, 2, 3:
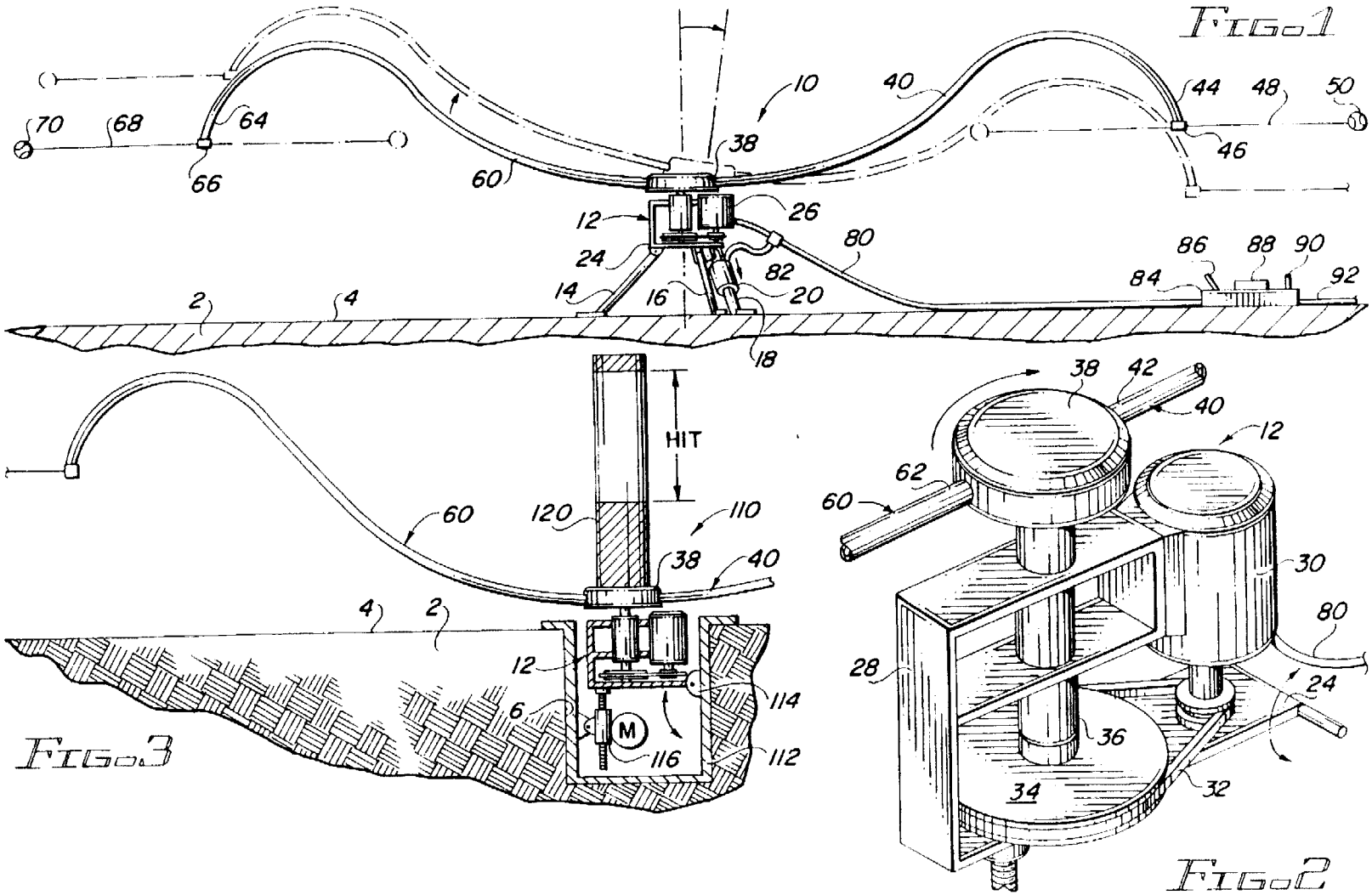
FIG. 1 is a side view of the apparatus of the present invention.
FIG. 2 is a perspective view of a portion of the apparatus of the present invention.
FIG. 3 is a side view of an alternate embodiment of the apparatus of FIG. 1.

FIG. 1 is a side view of batting practice apparatus 10 of the present invention. The batting practice apparatus 10 includes a base 12 which is disposed at grade level of ground 2. The grade level or surface is represented by reference numeral 4. That is, the base 12 is disposed on the surface 4 of the ground 2. The surface 4, of course, may be any desired surface, whether on ground, a concrete pad, or the like.

The base 12 includes three legs, including a pair of fixed legs 14 and 16 and an adjustable leg 18, secured to a base plate 24. The purpose of the adjustable leg 18 is to enable the base 12 to be tilted so as to provide rising and falling balls, as will be discussed below.

The length of the leg 18 may be adjusted in any convenient or desired manner. One such manner is illustrated by use of a screw jack and motor 20. Using a reversible motor with a screw jack, both well known and understood elements, the length of the leg 18 may be varied as desired to tilt the plate 24.

The base 12 further includes a plate 24 to which the legs, 14, 16, and 18 are secured. The plate 24, and the elements associated therewith, are best shown in FIG. 2.

FIG. 2 comprises a perspective view of the plate 24 and the drive elements for the apparatus. The plate 24 comprises a base plate to which a frame 28 is secured. The frame 28 is in turn secured to a motor 30. The motor 30 is connected to a pulley 34 by means of a belt 32. The pulley 34 is appropriately secured to a shaft 36 which extends upwardly through portions of the frame 28. The shaft 36 is in turn secured to a hub 38. The hub 38 comprises a central fastening element for a pair of arms 40 and 60. The hub 36 is disposed on the base 12 adjacent to the surface 4 so as to provide a relatively low profile for the apparatus, as may be understood from FIG. 1.

The arms 40 and 60 are substantially identical to each other. They extend outwardly and curve upwardly from the hub 38 and then downwardly and outwardly to terminate in outer ends, as shown in FIGS. 1 and 3. The arms include inner end portions 42 and 62, respectively, which are secured to the hub 38, as best shown in FIG. 2. The arms each include outer ends, including an outer end 44 and an outer end 64, to which are secured bearings 46 and 66, respectively, as shown in FIG. 2.

Secured to the bearings 46 and 66 are cords 48 and 68, respectively. Balls 50 and 70 are secured respectively to the outer ends of the cords 48 and 68.

The bearings 46 and 66 allow the cords 48 and 68 to rotate or move in response to movement of the balls 50 and 70, respectively, as they are hit by users (batters) of the apparatus 10.

The radial length of the arms 40 and 60 from the shaft 36 outwardly to the bearings is preferably less than ? greater than ? the length of the cords 48 and 68.

The tilting of the base 12 in response to the adjustment of the leg 18 is illustrated by the dash dot lines in FIG. 1. Since the balls 50 and 70 will move outwardly in response to centrifugal force, the balls will, in their rotation, be moving upwardly or downwardly as they rotate relative to the base 12. This allows batters standing at various places about the perimeter of the apparatus, or in position to hit the balls 50 and 70, to have an opportunity of hitting rising balls, falling balls, and level balls. That is, as the balls move to the lowest point in the circular orbit or into the highest point in the circular orbit, they will essentially be level.

On the other hand, if the leg 18 is adjusted so that the arms 60 and 40 rotate in a relatively level plane, then the balls 50 and 70 will be essentially level as they rotate.

As the balls 50 and 70 are hit, they move, along with their respective cord 48 and 68, and the movement is enhanced by the bearings 46 and 66.

Control of the motors 20 and 30 is accomplished by appropriate motor controls. An electrical cable 80 is shown extending from the motor 30 to a motor control box 84. Another electrical cable 82 is shown extending from the motor 20 to the cable 80.

Three control elements are illustratively shown in conjunction with the box 84. The control elements include a control switch 86 for the motor 30, a rheostat 88 also for the motor 30, and a control switch 90 for the motor 20.

Both motors 29 and 30 are reversible motors, and the switches 90 and 86, respectively, are three position switches, including a center off, forward, and reverse positions.

The rheostat 88 allows the speed of the motor 30 to be adjusted, as desired. Obviously, the motor 30 is a variable speed motor.

From the control box 84 a cable 92 extends to a source of electrical power.

FIG. 3 is a side view in partial section of an alternate embodiment of the apparatus of FIGS. 1 and 2. In FIG. 3, batting practice apparatus 110 is shown disposed within a hole 6 in the ground 2. A housing 112 is disposed in the hole 6, and the base 12 is in turn appropriately secured to the housing 112.

The plate 24 of the base 12 is pivotally secured to a bracket 114 which is in turn secured to an inner wall within the housing 112. Opposite the bracket 114 is a screw jack 116. The screw jack 116 is also secured within the housing 112 and opposite the bracket 114.

Included with the screw jack 116 is an electric motor. The rotation of the screw by the electric motor results in the pivoting of the base 12 to provide the same functions as the three legs 14, 16, and 18 of the embodiment illustrated in FIG. 1.

Except for the substitution of the bracket 114, the screw jack 116 and the housing 112 for the legs 14, 16, and 18, the apparatus 110 is substantially the same as the apparatus 10 of FIG. 1. However, the use of the in ground housing 112 for the legs 14, 16, and 18 renders the apparatus 110 relatively permanent. The apparatus 10, on the other hand, is very portable and may be moved to virtually any desired location, limited only by the length of the cables 80 and 92 and the availability of an electrical outlet or source of power.

The electrical cables and control box elements discussed above in conjunction with the apparatus 10 will also work with the apparatus 110. However, the electrical controls for the apparatus 110 may be permanent, or fixed. It will be noted that no electrical cables, controls, etc., are shown in conjunction with the apparatus 110.

An additional element, namely a hit zone pylon 120, may be added, if desired. The pylon 120 includes a hypothetical hit zone, so that a batter may tell what kind of hits are being made. Obviously, the pylon 120 may also be included in the apparatus 10 of FIG. 1, if desired.

Figure 4:
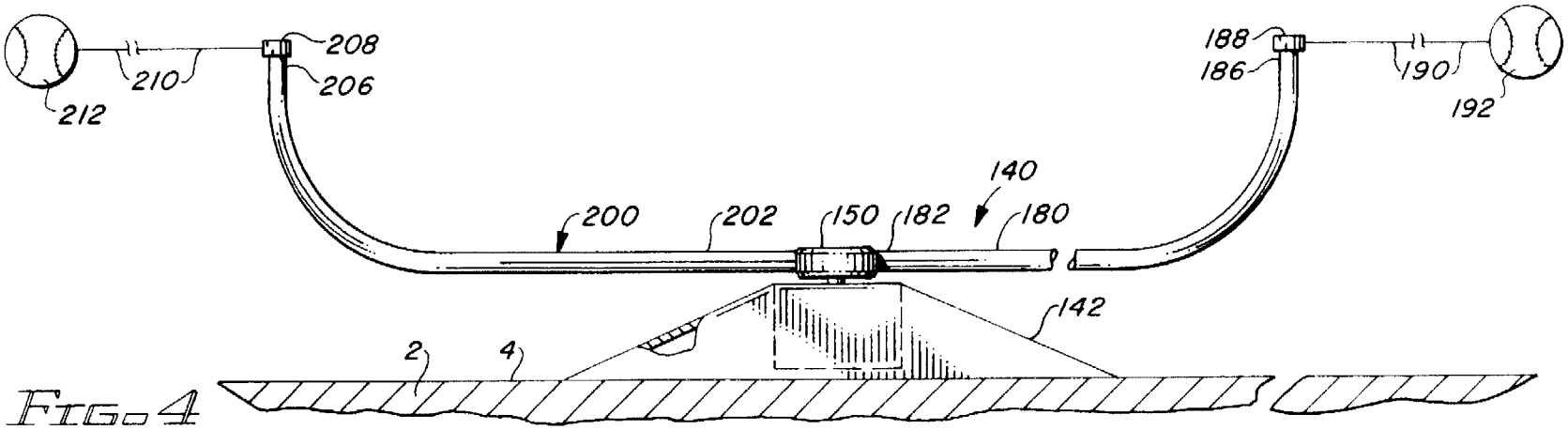
FIG. 4 is a side view of another alternate embodiment of the apparatus of the present invention.

FIG. 4 is a side view of an alternate embodiment 140 of the batting practice apparatus of the present invention. The alternate embodiment 140 includes a base 142 disposed on the top 4 of the ground 2.

The base 142 is generally of a triangular configuration, and with a relatively low profile, similar to the relatively low profile of the base 12 as shown in FIG. 1 and as discussed above. The elements of the plate 24, its motor 30, and the associated elements, are disposed within the base 142. The drive shaft 36 extends to a hub 150 adjacent to the base 142.

Figure 5:
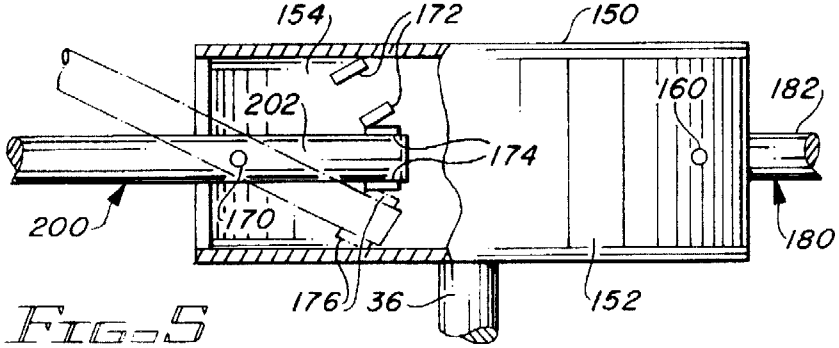
FIG. 5 is an enlarged view partially broken away of a portion of the apparatus of FIG. 4.

The hub 150 includes a pair of plates 152 and 154, appropriately secured to the shaft 36. Details of the plates 152 and 154 are best shown in FIG. 5. FIG. 5 comprises a side view of the hub 150, with a portion of the plate 152 broken away.

Adjacent to the opposite outer edges of the plates are pins or bolts which comprise pivot and securing elements for a pair of arms 180 and 200. A pin or bolt 160 is shown securing the arm 180 between the plates 152 and 154, and a pin or bolt 170 is shown securing the arm 200 between the plates 152 and 154.

Inwardly from the pins or bolts 160 and 162 are three locating knobs or bumps, either in pairs, or recesses, or the like, for each arm, and for each plate. The purpose of the locating elements is to allow the arms to be oriented as desired, either horizontal, or up or down. This is illustrated in conjunction with eh arm 200.

There is a top pair of locating elements 172 shown on the plate 154, a middle pair 174, and a bottom pair 176. The arm 200 is shown between the middle pair 174, and extending generally horizontally. The arm 200 extends downwardly when the inner end of the arm is disposed in the top pair 172. The arm 200 extends upwardly when its inner end is disposed in the bottom pair 176. The "up" and "down" orientations are indicated in dash dot line.

Since primarily side forces are exerted on the arms 180 and 200, the locating elements need not include bolts or pins, virtually any type of bumps or grooves or detents or the like may suffice for the locating elements.

The arms 180 and 200 may also be folded by pivoting them on their respective elements 160 and 170 for transport and storage purposes.

The arm 180 includes an inner end 182 at the hub 150, and an outer end 186 to which a bearing 188 is secured. A cord 190 extends from the bearing 188 to a ball 192.

The arm 200 includes an inner end 202, an outer end 206, and a bearing 208 at the outer end 206. A cord 210 extends from the bearing 208 to a ball 212.

The arms 180 and 200 extend generally straight outwardly from their inner ends and then curve upwardly to their outer ends. The configuration of the arms helps to provide a generally low profile for the apparatus 140.

Figure 6:
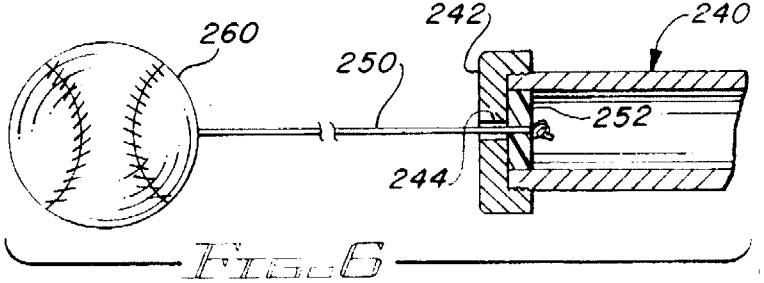
FIG. 6 is a view in partial section of an alternate embodiment of a portion of the apparatus of the present invention.

Another alternate embodiment is illustrated in FIG. 6. FIG. 6 comprises a view in partial section through an outer portion of an arm 240. The arm 240 is a straight arm, unlike the curved arms 40, 60 of FIGS. 1 and 3, and the arms 180, 200 of FIG. 4. The arm 240 is simply a tubular element with an end cap 242 through which extends an aperture 244. A tethered cord 250 extends through the aperture 244 and includes a knob 252 within the arm 240. The knob 252 is larger than the aperture 244, and accordingly the cord 250 is secured to the arm 240. At the outer end of the cord 250 is a ball 260.

Figure 7:
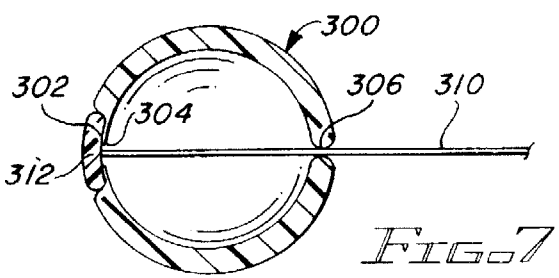
FIG. 7 is a view in partial section of a ball usable with the apparatus of the present invention.

FIG. 7 is an enlarged view in partial section of a ball 300 secured to a cord 310. The ball 300 includes a depression 302. The depression 302 is a circular depression coaxially aligned with an aperture 304. Diametrically opposite the depression 302 and the aperture 304 is an aperture 306. The cord 310 extends through the aperture 306 and the aperture 304. A button 312 at the outer end of the cord 310 is disposed in the depression 302. The depression 302 receives the button 312 and acts as a stop element for securing the ball 300 to the cord 310.

Figure 8:
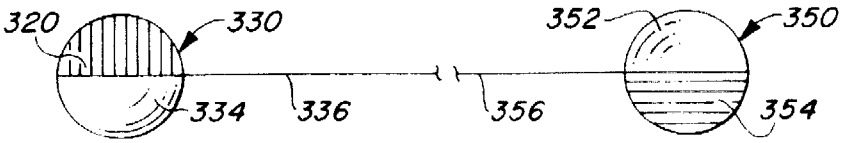
FIG. 8 is a schematic representation of balls usable with the aparatus of the present invention.

FIG. 8 comprises a schematic representation of two balls 330 and 350 secured respectively to cords 336 and 356. The two balls are divided into two hemispheres by color for enhanced visual imaging. One half of each ball is white, and the other half of each ball is colored.

The ball 330 includes a red top half 332 and a white bottom half 334, while the ball 350 includes a white top half 352 and a blue bottom half 354. Obviously, the choice of particular colors is arbitrary. The color dividing line is on the same diameter as the cord for each ball.

A batter aiming for the center line, or at the line which divides the balls, has a specific target area when the balls are color divided.

For safety purposes, foam balls may be used, or lightweight plastic shells, as desired. While the balls illustrated are "baseballs," it is obvious that "genuine" baseballs will not be used. Rather, lightweight ball elements will be used.

Moreover, while the apparatus has been illustrated in conjunction with batting, it is obvious that the apparatus can be used for practicing for virtually any sport where eye and hand coordination is required, such as tennis, handball, racquet ball, ping pong, etc. For the various sports, the arms and cords will be appropriately sized, and the "balls" will be appropriately sized and configured to appear as the ball of the desired sport. The speed of the ball will also be appropriately determined for the desired sport.

The primary purpose of the apparatus is, of course, to develop eye and hand coordination. Accordingly, the speed of the ball may start off slow. As the user progresses, the speed may increase, and the orientation of the ball may change by tilting the base or by adjusting the arms.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Batting practice apparatus comprising in combination:

a base having a relatively low profile to be disposed on a surface;

a hub rotatably disposed on and secured to the base;

a pair of oppositely extending arms secured to the hub, and each arm extends outwardly and upwardly from the hub and terminates in an outer end;

a cord secured to each outer end;

a ball secured to each cord remote from the outer end of each arm; and a motor for rotating the hub and the arms to rotate the balls for hitting.

2. The apparatus of claim 1 in which the arms are adjustably secured to the hub for changing the orientation of the arms.

3. The apparatus of claim 1 in which each arm includes a bearing at the outer end, and the cord is secured to the bearing.

4. The apparatus of claim 1 in which the arms are pivotally secured to the hub for changing the orientation of the arms.

5. The apparatus of claim 1 in which the motor is a variable speed motor for varying the rotational speed of the arms.

6. The apparatus of claim 5 in which the motor is also a reversible motor for rotating the arms in opposite directions.

7. The apparatus of claim 1 in which each ball is divided into two hemispheres by color.

8. The apparatus of claim 7 in which a cord is secured to a ball at the dividing line of the two hemispheres.

* * * * *